United States Patent [19]

Takimoto et al.

[11] 4,416,963

[45] Nov. 22, 1983

[54] ELECTRICALLY-CONDUCTIVE SUPPORT FOR ELECTROPHOTOGRAPHIC LIGHT-SENSITIVE MEDIUM

[75] Inventors: Masaaki Takimoto; Takashi Saida; Masataka Murata, all of Asaka, Japan

[73] Assignee: Fuji Photo Film Co., Ltd., Kanagawa, Japan

[21] Appl. No.: 253,952

[22] Filed: Apr. 13, 1981

[30] Foreign Application Priority Data

Apr. 11, 1980 [JP] Japan ..... 55-47665

[51] Int. Cl.[3] ..... G03G 5/10

[52] U.S. Cl. ..... 430/69; 430/950; 430/527; 430/530; 430/524; 430/63; 428/328; 428/329; 252/518

[58] Field of Search ..... 430/69, 527, 530, 424, 430/950, 63; 428/328, 329; 252/518, 520, 521

[56] References Cited

U.S. PATENT DOCUMENTS 2,624,240 1/1953 Blout et al. ..... 428/328

*Primary Examiner*—John D. Welsh

*Attorney, Agent, or Firm*—Sughrue, Mion, Zinn, Macpeak and Seas

[57] ABSTRACT

An electrically-conductive support for an electrophotographic medium, comprising a support and an electrically-conductive layer provided on the support is disclosed. The electrically-conductive layer comprises a binder and electrically-conductive metal oxide fine particles having an average grain size of 0.5$\mu$ or less, dispersed in the binder.

6 Claims, No Drawings

ELECTRICALLY-CONDUCTIVE SUPPORT FOR ELECTROPHOTOGRAPHIC LIGHT-SENSITIVE MEDIUM

FIELD OF THE INVENTION

This invention relates to a support for an electrophotographic medium and, more particularly, to an electrically-conductive support having high transparency.

BACKGROUND OF THE INVENTION

An electrophotographic light-sensitive medium is usually prepared using an electrically-conductive medium. Known electrically-conductive supports include a metallic plate, an insulative resin film with a metal or metal oxide thin film provided on the surface thereof by vacuum-deposition or sputtering, a paper made electrically-conductive using a polymeric electrolyte (e.g., a quaternary ammonium salt), and a support prepared by providing an electrically-conductive layer comprising a binder and electrically-conductive metal oxide particles dispersed therein on paper or a like material (support of this type is described in Japanese Patent Application (OPI) Nos. 25140/76 and 113224/77 (the term "OPI" as used herein refers to a "published unexamined Japanese patent application")). A method of providing a transparent electrically-conductive layer on a transparent resinous film wherein cuprous iodide is used is described in U.S. Pat. No. 3,428,451 and Japanese Patent Publication No. 34499/71. Furthermore, a method of providing a thin film of tin dioxide or indium oxide on glass or a like material is known.

However, problems described below arise in preparing a transparent electrophotographic light-sensitive medium utilizing the foregoing known methods. The term "transparency" as used herein means that the transmittance of light having a wavelength range including visible light is about 50% or more, and the light-scattering efficiency about 50% or less.

A metal-deposited film lowers transmittance and increases production costs. A metal oxide thin film further increases production costs, although it increases the transmittance. When a polymeric electrolyte is used, the resulting electrically-conductive layer has high dependency on humidity. When an electrically-conductive layer is provided on a transparent resinous film and interposed between the film support and a light-sensitive layer, the electrically-conductive layer often becomes highly resistant since the electrically-conductive layer is prevented from absorbing moisture.

The above-cited references disclosing use of electrically-conductive metal oxides indicate that the electrically-conductive layer contains a large amount of oxide particles in preferred embodiments. The amount of the binder is about 30 parts by weight or less per 100 parts by weight of particles. Therefore, it is difficult to form a transparent electrically-conductive layer.

When cuprous iodide is used, a transparent electrophotographic light-sensitive layer can be prepared. However, the layer has a pale yellow color and thus the quality of an image is disadvantageously deteriorated. In general, it is not desirable for the image background area to be colored yellow or red. However, it is acceptable if the background area is bluish.

In some cases, metal oxide thin film formed by vacuum-deposition or sputtering has inferior adhesion to the electrophotographic light-sensitive medium on which it is provided, while the method provides excellent transparency and electrical conductivity.

SUMMARY OF THE INVENTION

An object of this invention is to provide a transparent electrically-conductive support for an electrophotographic light-sensitive medium.

Another object of this invention is to provide a transparent and electrically-conductive support for an electrophotographic light-sensitive medium, prepared by a coating method which exhibits good adhesive properties to the electrophotographic light-sensitive medium.

This invention, therefore, provides an electrically-conductive support for an electrophotographic light-sensitive medium, which comprises a support and an electrically-conductive layer comprising a binder and electrically-conductive metal oxide particles having an average grain size of about 0.5$\mu$ or less, dispersed in the binder. The present support has a transmittance of light having a wavelength range including visible light of about 50% or more and a light-scattering efficiency of about 50% or less.

DETAILED DESCRIPTION OF THE INVENTION

Electrically-conductive fine particles which are preferably used in this invention include crystalline metal oxide particles, and those containing an oxygen-deficiency or small amounts of hetero atoms capable of forming a donor for the metal oxide used are particularly preferred because they generally have high conductivity.

Preferred examples of metal oxides include ZnO, $TiO_2$, $SnO_2$, $Al_2O_3$, $In_2O_3$, $SiO_2$, MgO, BaO, $MoO_3$, $ZrO_2$ and composite oxides thereof. Hetero atoms which can be used are Al, In, etc., for ZnO; Nb, Ta, etc., for $TiO_2$; Sb, Nb, halogen atoms, etc., for $SnO_2$; and so on. The amount of the hetero atom added is preferably from about 0.01 to 30 mol %, with the range of from about 0.1 to 10 mol % being particularly preferred.

It is preferable for the crystalline metal oxide particles of this invention to be small in order to minimize light-scattering. Size should be determined by considering the ratio of the refractive index of the particle to the refractive index of binder as a parameter. Based on the Mie principle (see G. Mie, *Ann. Physik.*, 25 377 (1908) and T. H. James, *The Theory of the Photographic Process*, 580–584, 4th Ed. (1977), published by Macmillan Co.), particle size corresponding to a light-scattering efficiency of 5, 10, 30 or 50%, concerning light having a wavelength of 550 nm, was determined. The results are shown in Table 1. Although the particle size corresponding to light-scattering efficiencies of light having different wavelengths can be determined, they are omitted in this application, and the results shown in Table 1 are regarded as particle size corresponding to a white light-scattering efficiency.

TABLE 1

| Light-Scattering Efficiency (%) | Ratio of Refractive Index (particle/binder) 1.1 (μ) | 1.2 (μ) | 1.3 (μ) | 1.4 (μ) | 1.5 (μ) | 1.6 (μ) | 2.0 (μ) |
|---|---|---|---|---|---|---|---|
| 5 | 0.33 | 0.20 | 0.16 | 0.13 | 0.12 | 0.11 | 0.09 |
| 10 | 0.44 | 0.25 | 0.19 | 0.16 | 0.14 | 0.13 | 0.11 |
| 30 | 0.70 | 0.38 | 0.27 | 0.23 | 0.19 | 0.18 | 0.14 |
| 50 | 0.90 | 0.47 | 0.33 | 0.27 | 0.23 | 0.20 | 0.16 |

With a light-sensitive medium having an image viewable with the naked eye and wherein imagewise exposure is applied from the side of a support, it is preferable if the light-scattering efficiency of the highlight part of the image is about 50% or less. With light-sensitive media, such as microfilm and those for use in an overhead projector, in which the image is projected, the light-scattering efficiency of the highlight is preferably about 20% or less.

In applications where the image is viewed by utilizing reflected light, as in general multiplication light-sensitive media, it is not necessary for the light-scattering efficiency to be small. Obviously no problems arise in applying the support of this invention to such applications.

The refractive indexes of typical metal oxides which can be used in this invention and which constitute a body of electrically-conductive particles are shown in Table 2.

TABLE 2

| Metal Oxide | Refractive Index |
|---|---|
| ZnO | 2.0 |
| $TiO_2$ | 2.7–2.9 |
| $SnO_2$ | 2.0 |
| $Al_2O_3$ | 1.7–1.8 |
| $SiO_2$ | 1.5 |
| $ZrO_2$ | 2.1–2.2 |

The binder used in the present invention has a refractive index in a range of about 1.4 to 1.6. Accordingly, based on the values shown in Table 1, a greater portion of the present invention is realized when electrically-conductive particles having a particle size of about 0.5μ or less are used. Sensitive materials having a remarkably high light transmittance which have 20% or less of the light-scattering efficiency can be obtained when electrically-conductive particles having a particle size of 0.2μ or less are used.

Preferably the electrically conductive layer used in the present invention has a surface resistivity of $10^{10}$ Ω or less, more preferably $10^8$ Ω or less, at 25° C. under a low humidity of 25% RH. Accordingly, the volume resistivity of the electrically-conductive particles is $10^6$ Ω-cm or less, preferably $10^4$ Ω-cm or less if the thickness of an electrically-conductive layer generally used is 1 μm or so.

The electrically conductive fine particles composed of crystalline metal oxides used in the present invention are produced in general by the following processes using, as a starting material, metal powders, hydrates of metal oxides, organic compounds containing a metal such as carboxylates (e.g., acetates, oxalates) and alkoxides, and the like. Firstly, they may be produced by sintering the starting material and heat treatment in the presence of hetero atoms in order to improve the electric conductivity. Secondly, they may be produced by sintering the starting material in the presence of hetero atoms for improving the electric conductivity. Thirdly, they may be produced by sintering the starting material in an atmosphere with a reduced oxygen concentration in order to create an oxygen-deficiency.

In the first process, the electric conductivity of the surface of fine particles can be effectively improved. However, it is necessary to select a condition for the heat treatment, because the particles may increase in size. Sometimes, it is preferable to carry out the heat treatment in a reductive atmosphere. The second process is preferable because it is believed to have the lowest cost for production. For example, in a process for obtaining $SiO_2$ fine particles by spraying a β-stannic acid colloid (amorphous) as a hydrate of $SnO_2$ in a sintering furnace, electrically-conductive $SnO_2$ fine particles can be obtained, if antimony chloride, antimony nitrate or a hydrate of antimony oxide is present in the β-stannic acid colloid. As another example, in the so-called gas phase process for producing $SnO_2$ and $TiO_2$ by oxidation of $SnCl_4$ and $TiCl_4$, electrically-conductive $SnO_2$ and $TiO_2$ can be obtained, if a salt of a hetero atom is present at the time of oxidation. Another process comprises decomposing an organic salt of metal by heating it in the presence of a salt of a hetero-metal atom. As an example of the third process, there is a vacuum evaporation process for obtaining metal oxide fine particles. The process comprises evaporating metals in an oxygen atmosphere wherein an amount of oxygen is insufficient or metals or metal salts are heated in an oxygen deficient atmosphere.

The electrically-conductive particles used in the present invention preferably have a smaller particle size within the limits of possibility. However, fine particles obtained by the above-described processes may firmly agglomerate forming large particles. In order to avoid formation of such large particles, auxiliary fine particles which do not contribute directly to improvement of the electric conductivity are used as an assistant for finely granulating in the production of electrically-conductive particles. Particles useful for this purpose include fine particles of metal oxide which are not prepared for the purpose of improving the electric conductivity (for example, ZnO, $TiO_2$, $SiO_2$, $Al_3O_3$, MgO, BaO, $WO_3$, $MoO_3$, $ZrO_2$ and $P_2O_5$; fine particles of sulfates such as $BaSO_4$, $SrSO_4$, $CaSO_4$ or $MgSO_4$; and fine particles of carbonates such as $MgCO_3$ or $CaCO_3$.

The particles exemplified in the above can be dispersed in a binder together with electrically-conductive fine particles, because they do not have a thick color. Further, in order to remove a greater part of the auxiliary particles and large particles, it is possible to carry out physical or chemical treatments. For example, it is effective to use a process which comprises selectively collecting ultra-fine electrically-conductive particles by filtration, decantation, centrifugal precipitation, etc,. after the particles have been dispersed and crushed in a liquid by means of a ball mill or a sand mill; and a process which comprises dissolving only the auxiliary particles after crushing as described above. The ultra-fine electrically-conductive particles can be more effectively produced if a surface active agent is added as a dispersing agent in the liquid; or by adding a small amount of a binder capable of being used in the present invention or a small amount of Lewis acid or Lewis base in the liquid. Of course, ultra-fine electrically-conductive particles can be further effectively obtained by repeating or combining the above-described operations.

It will be apparent to one skilled in the art that the use of a chemical treatment in combination with the foregoing treatment will make possible the use of a much greater range of particles as auxiliary particles.

The binder for the electrically-conductive layer may include proteins such as gelatin, colloidal albumin or casein; cellulose compounds such as carboxymethyl cellulose, hydroxyethyl cellulose, diacetyl cellulose or triacetyl cellulose; saccharide derivatives such as agar, sodium alginate or starch derivatives; synthetic hydrophilic colloids, for example, polyvinyl alcohol, poly-N-vinylpyrrolidone, acrylic acid copolymers, polyacrylamide and derivatives and partially hydrolyzed products of them, vinyl polymers and copolymers such as polyvinyl acetate or polyacrylate acid ester; natural materials such as rosin or shellac; and derivatives thereof; and other many synthetic resins. Further, it is possible to use aqueous emulsions of styrene-butadiene copolymer, polyacrylic acid, polyacrylic acid ester or derivatives thereof, polyvinyl acetate, vinyl acetateacrylic acid ester copolymer, polyolefin or olefin-vinyl acetate copolymer. Alternatively, it is possible to use colloids of a hydrate of metal oxides such as aluminum oxide, tin oxide or vanadium oxide, as a binder. The range of binders which can be used can be extended by cross-linking the binder with another material such as a hardener.

The binder of the electrically-conductive layer may be comprised of known electrically-conductive high molecular substances. Examples of these substances include polyvinylbenzenesulfonic acid salts, polyvinylbenzyltrimethyl ammonium chloride, quaternary polymer salts described in U.S. Pat. Nos. 4,108,802, 4,118,231, 4,126,467 and 4,137,217, etc., and cross-linkage type polymer latexes described in U.S. Pat. No. 4,070,189 and German Patent Application (OLS) No. 2,830,767 (U.S. Ser. No. 816,127), etc.

The amount of the electrically-conductive particles used is preferably from about 0.05 to 20 g per square meter of the photographic light-sensitive medium, with the range of from about 0.1 to 10 g being particularly preferred.

Although it is preferable to increase the volume content of electrically-conductive particles in the electrically-conductive layer in order to efficiently lower the resistance of the electrically-conductive layer, it is desirable to add at least 5% of a binder so that the electrically-conductive layer has sufficient strength. Thus, the volume content of the electrically-conductive particles is preferably from about 5 to 95%.

In order to obtain high transparency, it is preferable to minimize the volume content of electrically-conductive particles. Thus, the particularly preferred volume content is from about 5 to 50%.

Useful support materials include a cellulose nitrate film, a cellulose acetate film, a cellulose acetate butyrate film, a cellulose acetate propionate film, a polystyrene film, a polyethylene terephthalate film, a polycarbonate film, and a laminate thereof. Furthermore, it is possible to utilize a baryta, or a paper on which a polymer of $\alpha$-olefin containing 2 to 10 carbon atoms, such as polyethylene, polypropylene, and an ethylene-butene copolymer, is coated or laminated.

Depending on the intended purpose of the light-sensitive medium, it is possible to use either a transparent or opaque support. In addition to a colorless transparent support, it is possible to use a colored transparent support prepared by the addition of dye or pigment.

The electrically-conductive support of this invention can be used in combination with all kinds of known electrophotographic light-sensitive media. Examples of such light-sensitive media include those light-sensitive media comprising a selenium vacuum-deposited film, an amorphous silicon thin film, a zinc oxide thin film, a layer comprising a resin and zinc oxide dispersed therein, a layer comprising a resin and cadmium sulfide dispersed therein, polyvinyl carbozole, a layer comprising a resin and an organic pigment dispersed therein, a layer comprising polycarbonate and an organic photoconductive material dispersed therein, and an electron generation layer and electron transfer layer. The electrically-conductive layer of this invention is characterized by its transparency. Accordingly, the invention is suitable for a transparent electrophotographic light-sensitive medium. Furthermore, it can be used in a situation wherein exposure is applied from the side of the support.

The electrically-conductive support of this invention is useful not only for an electrophotographic light-sensitive medium comprising the electrically-conductive support and a photoconductive insulative layer provided thereon, but also as an electrically-conductive support for electrophotographic media, such as an electrostatic recording medium and a transfer medium. Furthermore, it can be used as a transparent electrode for an electrophoretic process.

The following Examples are given to illustrate this invention in greater detail.

EXAMPLE 1

A mixture of 65 parts by weight of stannic chloride hydrate and 1.5 parts by weight of antimony trichloride was dissolved in 1,000 parts by weight of ethanol to prepare a uniform solution. To the uniform solution, 1N aqueous sodium hydroxide solution was added dropwise until the pH of the solution reached 3 to thereby obtain co-precipitated colloidal stannic oxide and antimony oxide. The thus-obtained co-precipitated product was allowed to stand at 50° C. for 24 hours to obtain a red-brown colloidal precipitate.

The red-brown colloidal precipitate thus-obtained was separated with a centrifuged separator. In order to remove excessive ions, water was added to the precipitate and the resulting mixture was subjected to centrifugal separation to wash the precipitate. This procedure was repeated three times to remove excessive ions.

The thus-obtained excessive ion-free colloidal precipitate (100 parts by weight) was mixed with 50 parts by weight of barium sulfate having an average grain size of $0.3\mu$ and 1,000 parts by weight of water. The resulting mixture was sprayed in a burning furnace maintained at 900° C. to obtain a bluish powdery mixture comprising stannic oxide and barium sulfate and having an average grain size of $0.1\mu$.

The thus-obtained mixture (1 g) was placed in an insulative cylinder having an inner diameter of 1.6 cm. The specific resistance of the powder was measured with stainless steel electrodes while sandwiching the powder with the stainless steel electrodes at a pressure of 1,000 kg/cm$^2$. The specific resistance was found to be 11 $\Omega$-cm.

EXAMPLE 2

| | parts by weight |
|---|---|
| $SnO_2$ Powder | 10 |
| Water | 150 |
| 30% Aqueous Solution of Ammonia | 1 |

A mixture comprising the foregoing ingredients was dispersed for 1 hour with a paint shaker to obtain a uniform dispersion. This uniform dispersion was subjected to centrifugal separation at 2,000 rpm for 30 minutes to remove coarse particles. The supernatant liquid thus-obtained was subjected to centrifugal separation at 3,000 rpm for 1 hour to obtain an $SnO_2$ paste comprising fine particles.

The thus-obtained $SnO_2$ paste (10 parts by weight) was mixed with 25 parts by weight of a 10% aqueous solution of gelatin and 100 parts by weight of water. The resulting mixture was dispersed for 1 hour with a paint shaker to obtain an electrically-conductive coating solution.

The electrically-conductive coating solution was coated on a 100 μm polyethylene terephthalate (PET) film in a dry coating amount of 2 g/m$^2$ to obtain an electrically-conductive support.

After the electrically-conductive support was allowed to stand for 2 hours under the conditions of 25° C. and 25% RH, the surface resistance of the electrically-conductive layer was measured with an insulation resistance measuring unit (Model VE-30, produced by Kawaguchi Denki Co., Ltd.) and was found to be $2\times10^6$ Ω. The light-scattering of the electrically-conductive support was measured with a scattering measuring device (produced by Narumi Co., Ltd.) and was found to be 15%.

EXAMPLE 3

On the electrically-conductive support obtained in Example 2 was provided an organic photoconductive layer by the method as described hereinafter to obtain a transparent electrophotographic light-sensitive medium.

Poly-N-vinyl carbazole (trade name: Rupican 170, produced by BASF, intrinsic viscosity $[\eta]=1.18$, in tetrahydrofuran, 25° C.) (6 parts by weight) was dissolved in 150 parts by weight of ethylene chloride, to which was further added a dye (I) or (II) having the formula as shown below in an amount of $10^{-3}$ mol based on a carbazole ring unit to prepare a coating solution.

Dye (I)

1',3-Diethyl-8-azathia-4'-carbocyanine perchlorate

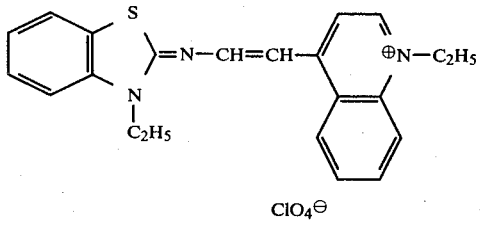

Dye (II)

3-Methyl-1',3',3'-trimethylindo-8,9-diazathiacarbocyanine perchlorate

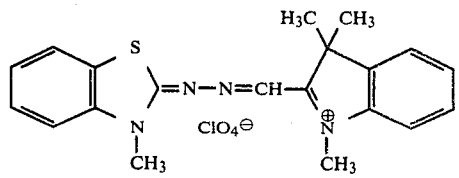

The thus-obtained coating solution was coated on the transparent electrically-conductive support obtained in Example 2 in a dry thickness of about 2μ to obtain a good electrophotographic light-sensitive medium.

The spectral transmittance of the light-sensitive medium as prepared above was about 90% at the maximum absorption wavelength of the sensitizing dye, and it had a light-scattering efficiency of 10% and thus had markedly high transparency.

The light-sensitive medium was charged at +300 V by corona discharge, and its sensitivity was then measured. In either of the light-sensitive media, the exposure amount required for reducing the potential to one-half the original potential was about 40 Lux·sec.

Next, the surface of the light-sensitive medium was charged at −300 V and imagewise exposed from the side of the support, and its sensitivity was then measured. The half-reduction exposure amount as 55 Lux·sec because the effect of PET as a support to absorb ultraviolet rays exerted a certain influence.

EXAMPLE 4

On the transparent electrically-conductive support obtained in Example 2 was coated an organic photoconductive layer. 2,4,7-trinitrofluorenone had been added to the layer in an amount of 0.5 mol based on the carbazole ring unit of polyvinyl carbazole. The dry thickness of the layer was about 2μ on resulting electrophotographic light-sensitive medium.

For comparison, the same organic photoconductive layer as above was coated on an aluminum plate.

Both the electrophotographic light-sensitive media thus-prepared were charged at −240 V, and their sensitivity was then measured. The exposure amount required for reducing the potential to one-half the original potential was 11 Lux·sec.

The surface of the light-sensitive medium was charged at −250 V, exposed to light through a positive original, and then developed with positively charged toners. Subsequently, a transfer paper on the market for use in electrostatic multiplication was placed on the toner image obtained above and after application of negative corona discharge from the back of the transfer paper, it was removed. The toner image was transferred to the transfer paper and thus a good copied image was obtained.

EXAMPLE 5

Using a dye (III) having the structure as shown below in an amount of $10^{-3}$ mol per carbazole ring unit of polyvinyl carbazole, an electrophotographic light-sensitive medium was prepared according to the same method as described in Example 3. The maximum absorption of the light-sensitive medium thus-obtained was present at 820 nm in the infrared region, and thus a colorless transparent light-sensitive medium was obtained. That is, the light-sensitive medium absorbed almost no visible light, and the light-scattering efficiency was 9%.

The light-sensitive medium was charged at +400 V, subjected to scanning exposure through a positive original by the use of semiconductor laser (835 nm by Model MEL 4742 produced by Matsushita Electronics Corporation, and 810 nm by Model HLP 3600 produced by Hitachi Corp.), and liquid-developed with negatively charged toners to thereby obtain a good image.

Dye (III)

2,6-Di-tert-butyl-4-[5-(2,6-di-tert-butyl-4H-thiopyran-4-iridene)penta-1,3-dienyl]thiopyririum perchlorate

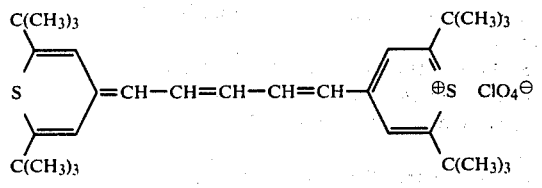

EXAMPLE 6

A mixture of 2 parts by weight of electrically-conductive fine particles as obtained in Example 1 and 1 part by weight of polyvinyl alcohol was coated on both sides of a high quality paper (basis weight, 75 g/m$^2$) in an amount of 2 g/m$^2$ (on each side) to thereby obtain an electrically-conductive paper having a surface resistance of $10^7$ Ω.

EXAMPLE 7

One side of the electrically-conductive paper as obtained in Example 6 was provided a dye sensitized zinc oxide light-sensitive layer having the following formulation in an amount of 28 g/m$^2$.

| | parts by weight |
|---|---|
| Zinc Oxide (Sazex 2000, produced by Sakai Chemical Co., Ltd.) | 100 |
| Acryl Resin (DIANAL LR-018, produced by Mitsubishi Rayon Co., Ltd.) | 15 |
| Dye C.I. ACID YELLOW 73 (43350) | 0.003 |
| Dye C.I. AID RED 94 (45440) | 0.003 |
| Dye C.I. ACID BLUE 9 (42090) | 0.003 |

An almost white, good light-sensitive medium was obtained. By charging the surface of the light-sensitive medium at −340 V, imagewise exposing to light through a positive original, and liquid-developing with positively charged toners, a good image was obtained.

EXAMPLE 8

On one side of the electrically-conductive paper as obtained in Example 6 was provided an insulative layer having the formulation as shown below in an amount of 5 g/m$^2$ to provide a good electrostatic recording paper.

| | parts by weight |
|---|---|
| Polyvinyl Butyral Resin (BUTVAR B-76, produced by | 100 |

-continued

| | parts by weight |
|---|---|
| SCHAVINIGAN Corp.) Calcium Carbonate Powder | 25 |

On the transparent electrically-conductive support as obtained in Example 2 was provided a photoconductive layer having the formulation as shown below in an amount of 30 g/m$^2$ to thereby obtain a light-sensitive medium.

| | parts by weight |
|---|---|
| Zinc Oxide | 100 |
| Acryl Resin (DIANAL LR-018) | 15 |
| Dye C.I. ACID RED 51 (45430) | 0.1 |

The thus-obtained light-sensitive medium was placed on a glass plate and the electrically-conductive layer was connected to the ground. The electrostatic recording medium as obtained above was placed on the light-sensitive medium in such a manner that the electrostatic recording layer came in contact with the surface of the light-sensitive medium. Additionally, an aluminum plate was placed on the back of the recording paper. While applying +500 V on the aluminum plate, a negative image was projected through the glass plate (electrostatic image transfer process). After stopping the application of the voltage, the electrostatic recording paper was removed from the light-sensitive medium and liquid-developed with positively charged toners to obtain a positive image.

EXAMPLE 9

A mixture of 65 parts by weight of stannic chloride pentahydrate and 4 parts by weight of antimony trichloride was dissolved in 1,000 parts by weight of ethanol to prepare a uniform solution. To the uniform solution, 1N aqueous sodium hydroxide solution was added dropwise until the pH of the solution reached 3 to thereby obtain co-precipitated colloidal stannic oxide and antimony oxide.

The red-brown colloidal precipitate thus-obtained was separated with a centrifugal separator. In order to remove excessive ions, water was added to the precipitate and the resulting mixture was subjected to centrifugal separation to wash the precipitate.

The thus-obtained excessive ion-free colloidal precipitate (100 parts by weight) was mixed with 1,000 parts by weight of water. The resulting mixture was sprayed in a burning furnace maintained at 700° C. to obtain bluish particles of stannic oxide.

The same procedures as in Example 2 were repeated using the stannic oxide particles to prepare an electrically-conductive support. The surface resistance and the light-scattering of the electrically-conductive support were measured in the same manner as in Example 2 and were found to be $2\times10^6$ Ω and 15%, respectively.

EXAMPLE 10

2.7 Parts by weight of niobium pentachloride was dissolved in 50 parts by weight of ethanol, and 65 parts by weight of titanium oxide fine particles (particle size: 0.02–0.05μ; TTO-55, produced by Ishihara Sangyo Kaisha Ltd.) was added thereto, under stirring, to obtain a dispersion. The dispersion was heated to 60° C. and allowed to stand for 3 hours to thereby evaporate ethanol. The resulting powder was charged in a procelain crucible and burned at 800° C. for 5 minutes under vacuum ($1\times10^{-4}$ mmHg) to obtain bluish particles having a specific resistance of $5\times10^{2}$ Ω-cm.

Using the particles, the same procedures as in Example 2 were repeated, and the surface resistance and the light-scattering of the resulting electrically-conductive support were found to be $3\times10^{8}$ Ω and 30%, respectively.

While the invention has been described in detail and with reference to specific embodiments thereof, it will be apparent to one skilled in the art that various changes and modifications can be made therein without departing from the spirit and scope thereof.

What is claimed is:

1. An electrically-conductive support for use in an electrophotographic medium, comprising: a support; and an electrically-conductive layer provided on the support wherein the electrically-conductive layer comprises a binder and electrically conductive metal oxide fine particles having an average grain size of 0.5μ or less and a volume resistivity of $10^{6}$ Ω-cm or less, dispersed in a binder, wherein said electrically-conductive metal oxide fine particles are selected from the group consisting of crystalline metal oxide particles and metal oxide particles containing an oxygen deficiency or small amounts of hetero atoms capable of forming a donor for the metal oxide used, wherein said electrically-conductive support is transparent such that it has a transmittance of light, having a wavelength range including visible light, of about 50% or more, and a light-scattering efficiency of about 50% or less.

2. An electrically-conductive support as in claim 1, wherein said metal oxide is selected from the group consisting of ZnO, $TiO_2$, $SnO_2$, $Al_2O_3$, $In_2O_3$, $SiO_2$, MgO, BaO, $MoO_3$, $ZrO_2$ and composite oxides thereof.

3. An electrically-conductive support as in Claim 1, wherein said metal oxide is one selected from the group consisting of ZnO, $TiO_2$, $SnO_2$, $Al_2O_3$, $In_2O_3$, $SiO_2$, MgO, BaO, $MoO_3$, $ZrO_2$ and composite oxides thereof, modified by introduction of an oxygen deficiency or small amounts of hetero atoms capable of forming a donor for the metal oxide used.

4. An electrically-conductive support as in claim 1, wherein said metal oxide contains an oxygen-deficiency.

5. An electrically-conductive support as in claim 1, wherein said electrically-conductive layer has a surface resistivity of $10^{10}$ Ω or less at 25° C. under 25% relative humidity.

6. An electrically-conductive support as in claim 1, wherein said fine particles are contained in an amount of 0.05 to 20 g per square meter of said support.

* * * * *